US005826941A

United States Patent [19]

Olsen

[11] Patent Number: 5,826,941

[45] Date of Patent: Oct. 27, 1998

[54] ADJUSTABLE FOOT REST

[76] Inventor: David L. Olsen, 9 Orchard La., Wolcott, Conn. 06716

[21] Appl. No.: 858,454

[22] Filed: May 19, 1997

[51] Int. Cl.[6] ..... A47C 16/02

[52] U.S. Cl. ..... 297/423.39; 297/423.1; 297/423.26; 108/108; 248/279.1

[58] Field of Search ..... 297/423.1, 423.25, 297/423.26, 423.39, 423.41; 108/108; 248/278.1, 279.1

[56] References Cited

U.S. PATENT DOCUMENTS

| | | | |
|---|---|---|---|
| 1,849,991 | 1/1932 | Hayer | 248/279.1 X |
| 2,019,789 | 11/1935 | Mahannah | 248/279.1 X |
| 2,488,316 | 11/1949 | Mosby | 248/279.1 |
| 2,982,344 | 5/1961 | Berlin | 248/279.1 X |
| 3,770,334 | 11/1973 | Weber . | |
| 3,833,090 | 9/1974 | Georgianna . | |
| 3,902,568 | 9/1975 | Erickson . | |
| 4,450,936 | 5/1984 | Strom . | |
| 4,934,645 | 6/1990 | Breslow | 108/108 X |
| 5,098,160 | 3/1992 | Moore et al. . | |
| 5,452,875 | 9/1995 | Kern | 108/108 X |
| 5,582,464 | 12/1996 | Maymon | 297/423.26 X |

*Primary Examiner*—Peter R. Brown
*Attorney, Agent, or Firm*—Richard C. Litman

[57] ABSTRACT

An adjustable foot rest for use in the bracket mounting channels of an acoustical office partition panel. Two support arms are removably secured to the bracket mounting channels and the support arms are pivotally connected to and support a resting member. Each support arm comprises an inner portion and an outer portion, the inner portion including a sleeve and a telescoping member slidably insertable within the sleeve. The outer portion has a hinge for medially maneuvering the each support arm. The outer portion and inner portion join to form a toothed adjustment joint which allows for inclination adjustment of the resting member.

4 Claims, 3 Drawing Sheets

ADJUSTABLE FOOT REST

BACKGROUND OF THE INVENTION

1. Field of the Invention

The present invention relates to foot rests and, more particularly, to adjustable foot rests that may be used in conjunction with frame structures of acoustical office partition panels frame.

2. Description of Related Art

As people are working at desks more than ever before, ergonomic office environments are crucial to increasing workplace productivity and are important in avoiding work-related injuries. The ergonomic working environment therefore benefits both the worker and the employer, and significant improvements in productivity have been achieved through the application of ergonomic principles. The ergonomically correct way to sit at a desk is with the forearms straight, shoulders down, thighs straight and feet flat.

Unfortunately, the height of desks and chairs is often mismatched, resulting in the worker taking a kyphotic or rounded-back posture, increasing neck, back and shoulder strain, thereby increasing the risk of a work-related injury. It is therefore crucial for workers to maintain proper body position in order to avoid such problems.

Inventions purporting to ergonomically improve the workplace are well known in the prior art. One such invention is disclosed in U.S. Pat. No. 3,770,234 which issued to R. Weber on Nov. 6, 1973. This invention discloses a combination desk and chair that also includes an integrated footrest.

U.S. Pat. No. 5,098,160 which issued to Moore et al. on Mar. 24, 1992 discloses an ergonomic seating system apparatus comprising a chair engaging fixture and footrest mounted on a linear alignment member that sits on the floor. The footrest includes drive motors for adjustment of the height and inclination of the footrest.

Steps designed to removably fit columnar openings are also known in the prior art. U.S. Pat. No. 3,833,090 which issued to Georgianna on Sep. 3, 1974, U.S. Pat. No. 3,902,568 which issued to Erickson on Sep. 2, 1975, and U.S. Pat. No. 4,450,936 which issued to Strom on May, 29, 1984, all describe such inventions. However, these inventions are not adjustable and can therefore only fit openings of a specified distance apart. Additionally, these inventions do not provide for lateral adjustment by the user.

None of the above inventions and patents, taken either singularly or in combination, is seen to describe the instant invention as claimed. Thus, an adjustable foot rest solving the aforementioned problems is desired.

SUMMARY OF THE INVENTION

The present invention provides an adjustable foot rest for use in the bracket mounting channels of an acoustical office partition panel. Two support arms are removably secured to the bracket mounting channels by a claw bracket mounted on each arm. The claw has a fixed tooth and an articulative tooth that enable the support arms to fit virtually any type of acoustical office partition panel. The support arms are pivotally connected to and support a resting member.

Each support arm comprises an inner portion and an outer portion, the inner portion including a sleeve and a telescoping member slidably insertable within the sleeve for lateral adjustment of the support arms. The outer portion additionally has a hinge for medially maneuvering each support arm. The outer portion and inner portion join to form a toothed adjustment joint which rotates about a threaded pin allowing for the inclination adjustment of the resting member, the joint being secured in place by a threaded wing nut.

Accordingly, it is a principal object of the invention to provide an adjustable foot rest that enables the worker to sit in an ergonomically correct fashion.

It is another object of the invention to provide an adjustable foot rest that increases worker productivity while simultaneously reducing the risk of work-related injuries.

It is a further object of the invention to provide an adjustable foot rest that may fit in virtually all types of bracket mounting channels of an acoustical office partition panel.

Still another object of the invention is to provide an adjustable foot rest that may be adjusted to any desired position.

It is an object of the invention to provide improved elements and arrangements thereof in an adjustable foot rest for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
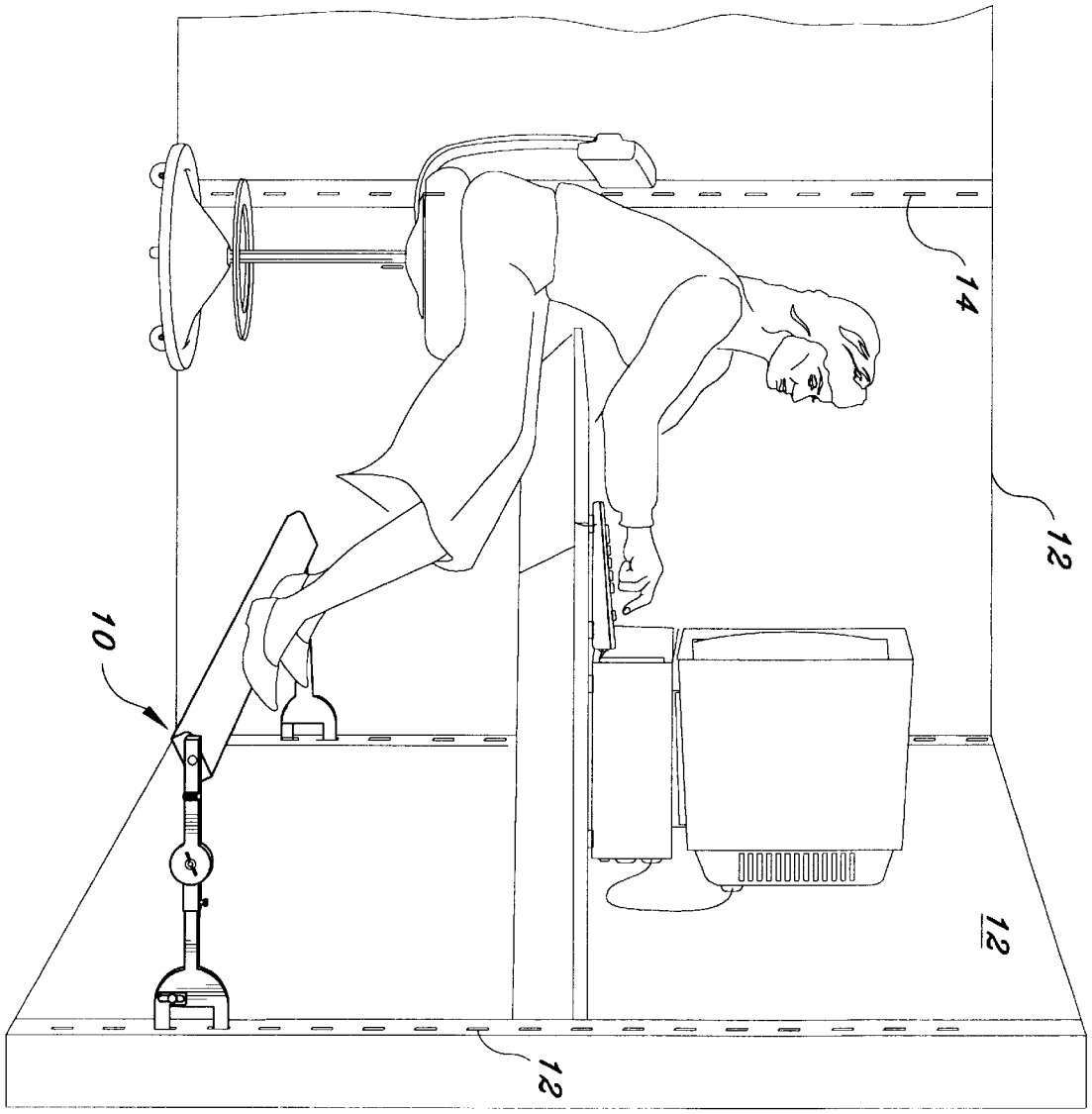
FIG. 1 an environmental, perspective view of an adjustable foot rest according to the present invention.

Referring now to the drawings wherein like numerals represent like elements, FIG. 1 shows an adjustable foot rest 10 according to the present invention, which is shown in use with an acoustical office partition panel 12 having bracket mounting channels 14. The bracket mounting channels 14 of the acoustical office partition panel 12 are of the type that provide for the interlocking of partition panels to one another, and allow the mounting of tabletops, shelves, cabinets and similar elements.

Figure 2:
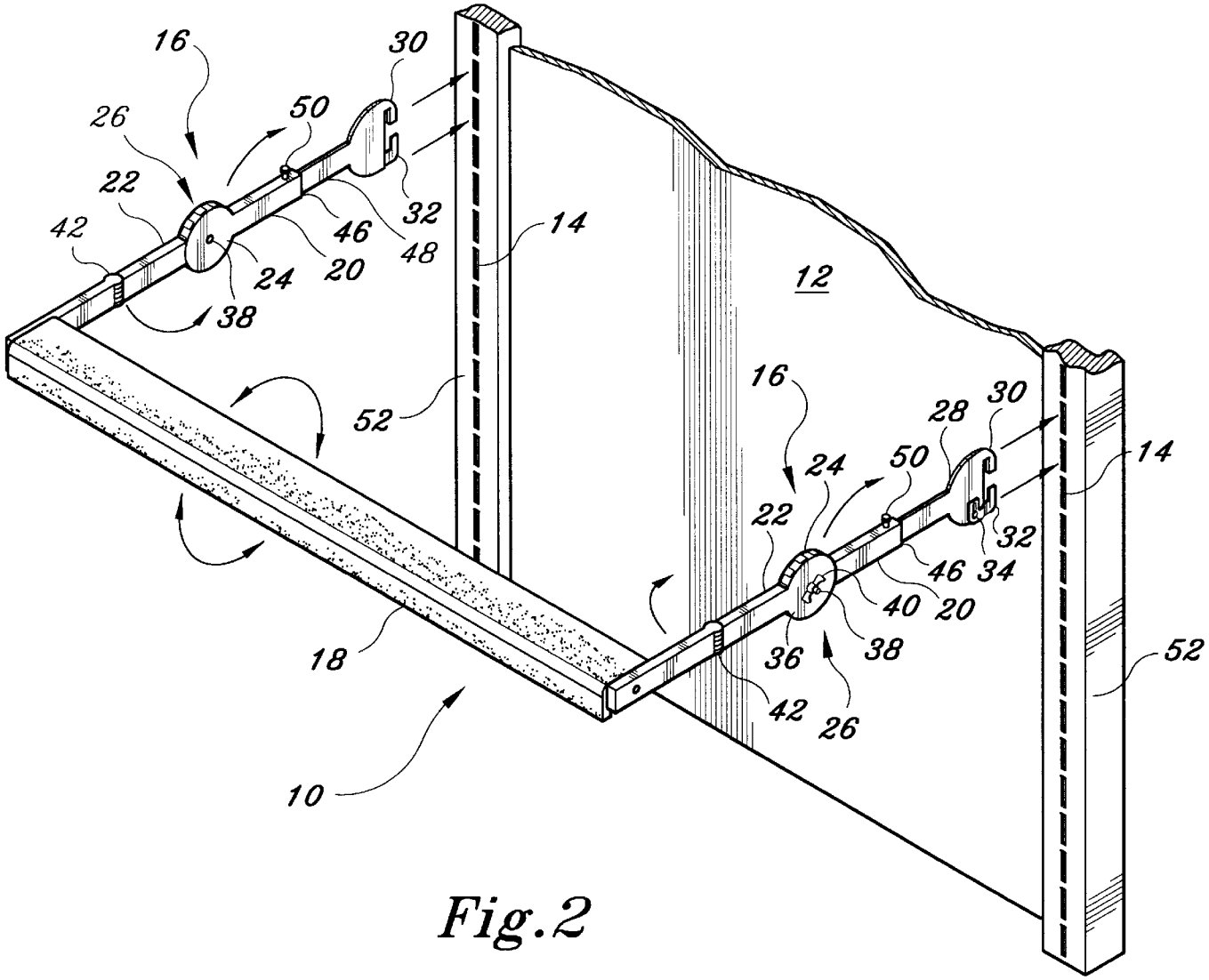
FIG. 2 is a perspective view of the present invention being inserted into an acoustical office partition panel.

Referring to FIG. 2, the adjustable foot rest 10 generally comprises a pair of support arms 16 and a resting member 18 for the user's feet. Each support arm 16 has an inner portion 20 and an outer portion 22, the inner portion of each support arm 16 having one end that is disposed to be secured to the bracket mounting channels 14 of the acoustical office partition panel 12 and an opposite end having a first toothed member 24 that comprises one-half of a toothed adjustment joint 26.

The one end of each support arm 16 is secured to the office partition panel 12 by a claw 28. The claw 28 comprises a fixed tooth 30 that fits into a bracket mounting channel 14 and a slidably adjustable articulative tooth 32 that fits into a complimentary bracket mounting channel 14. The articulative tooth 32 is affixed to the claw 28 opposite the fixed tooth 30, and an adjustment knob 34 present on the claw allows the articulative tooth to be removably secured in position on the claw.

Figure 3:
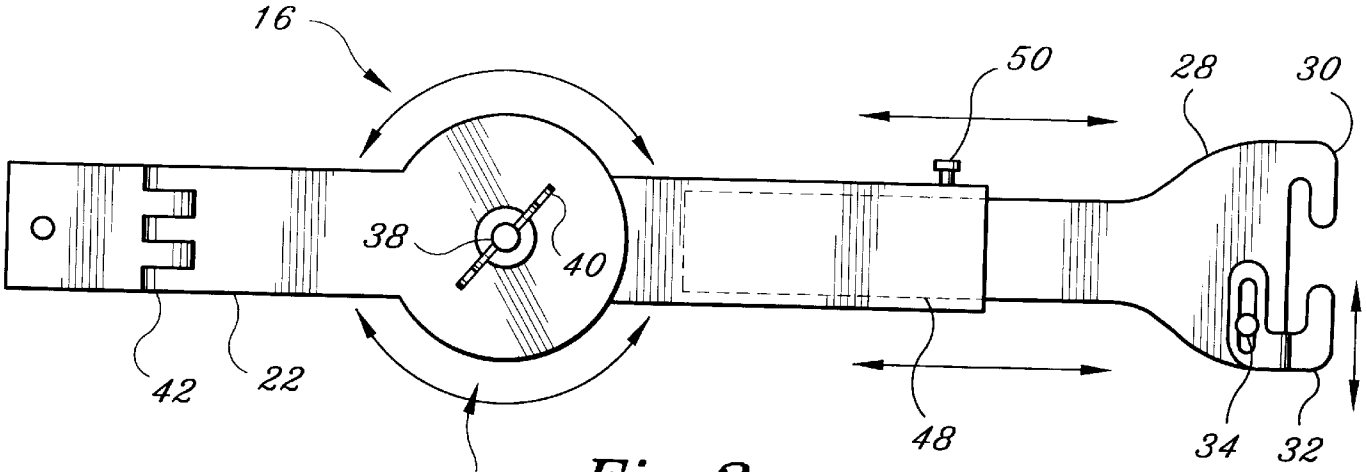
FIG. 3 is a side elevational view of the support arm of the present invention.
Figure 4:
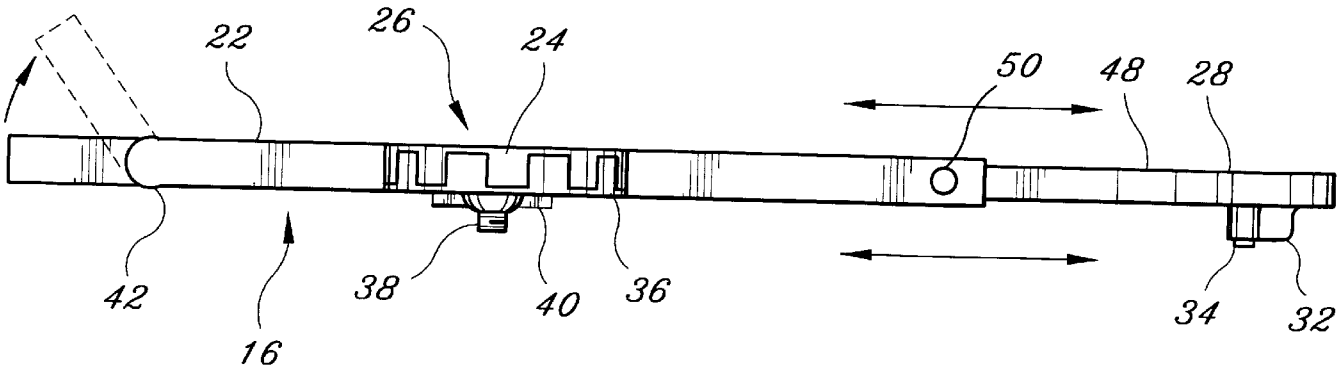
FIG. 4 is a top view of the support arm of the present invention.

Referring to FIGS. 2 and 3 generally, the inner portion 20 of each support arm 16 additionally has a sleeve 46 configured to receive a telescoping member 48, the telescoping member being slidably insertable through the sleeve, thereby allowing the length of each support arm to be laterally adjusted. Once the desired length of each support arm 16 is reached, a securing knob 50 threadedly secured through a securing aperture (not shown) on each sleeve 46 is twisted to removably maintain the telescoping member 48 in relation to the sleeve.

The outer portion 22 of each support arm 16 has one end having a second toothed member 24 that comprises the other half of the toothed adjustment joint 26, and an opposite end that supports the resting member 18. Each toothed member 24, 36 has a rotation aperture (not shown). The rotation apertures align in registry with one another, and a threaded pin 38 is inserted therethrough. The outer portion 22 may then be rotated about the axis of the threaded pin 38. Once each outer portion 22 is set to the desired inclination, the toothed adjustment joint 26 is then secured in position by a wing nut 40 threadedly fitted over the threaded pin 38, thereby articulately securing the toothed members 24, 36 of the toothed adjustment joint 26 to one another. Additionally, a hinge 42 having a vertically oriented pivot axis relative to the horizontally extending support arm 26 is present on the outer portion 22 of each support arm 26 for medial maneuvering of each support arm, enabling the adjustable foot rest 10 to be mounted in a corner where two acoustical office partition panels 12 intersect.

Referring back to FIG. 2, the resting member 18 has opposed ends, one end being pivotally connected to the opposite end of the outer portion 22 of one support arm 16, and the other end of the resting member being pivotally connected to the opposite end of the outer portion of the other support arm. The resting member 18 pivots to allow the user to exercise and to maintain blood flow in the legs. The need for the worker to get up and walk around may therefore be reduced, thereby increasing worker productivity.

To install the adjustable foot rest 10, the fixed tooth 30 of one support member 16 is inserted into the bracket mounting channel 14 of one column 52 of bracket mounting channels, and the fixed tooth of the other support member 16 is inserted into the bracket mounting channel of another column 52 of bracket mounting channels. The slidably adjustable articulative tooth 32 of one support member 16 is inserted into a corresponding bracket mounting channel 14 of one column 52 of bracket mounting channels, and the slidably adjustable articulative tooth of the other support member 16 is inserted into a corresponding bracket mounting channel of another column 52 of bracket mounting channels. Once all teeth 30, 32 have been inserted into a bracket mounting channel 14, the adjustment knob 34 of each claw 28 is turned to maintain the position of the slidably adjustable articulative tooth 32, thereby securing the adjustable foot rest 10 to the acoustical office partition panel 12.

It is to be understood that the present invention is not limited to the embodiment described above, but encompasses any and all embodiments within the scope of the following claims.

I claim:

1. An adjustable foot rest for use in an environment having substantially vertical, bracket mounting channels, the adjustable foot rest comprising:

first and second support arms adapted to be secured to the bracket mounting channels, each said support arm comprising:

(1) an inner portion having opposed ends, one of said ends having a first toothed member and the other of said ends having a claw for removably securing each said support arm to the bracket mounting channels, said claw including a fixed tooth, a slidably adjustable articular tooth opposite said fixed tooth and an adjustment knob for adjustably securing said articular tooth; and (2) an outer portion having opposed ends, one of said ends having a second toothed member articulately connected to said first toothed member, there further being a threaded pin connecting said first and second toothed members, said outer portion being axially rotatable about said threaded pin; and a foot supporting and resting member connected to the other of said ends on said outer portions of said first and second support arms.

2. The adjustable foot rest as defined in claim 1, further comprising:

a first sleeve on said inner portion of said first support arm and a cooperating, first telescoping member on said inner portion of said first support arm, said first telescoping member of said inner portion of said first support arm being slidably insertable through said first sleeve of said inner portion of said first support arm and removably secured within said first sleeve of said inner portion of said first support arm by a first securing knob; and a second sleeve present on said inner portion of said second support arm and a second telescoping member present on said inner portion of said second support arm, said second telescoping member of said inner portion of said second support arm being slidably insertable through said second sleeve of said inner portion of said second support arm and removably secured within said second sleeve of said inner portion of said second support arm by a second securing knob.

3. An adjustable foot rest for use in an environment having substantially vertical, bracket mounting channels, the adjustable foot rest comprising:

first and second support arms adapted to be secured to the bracket mounting channels, each said support arm comprising:

(1) an inner portion having opposed ends, one of said ends having a first toothed member and the other of said ends having mounting means for mounting each said support arm to the bracket mounting channels; and (2) an outer portion having opposed ends, one of said ends having a second toothed member articulately connected to said first toothed member, there further being a threaded pin connecting said first and second toothed members, said outer portion being axially rotatable about said threaded pin;

a first hinge present on said outer portion of said first support arm, said first hinge having a vertically oriented pivot axis relative to said first support arm, and a second hinge present on said outer portion of said second support arm, said second hinge having a vertically oriented pivot axis relative to said second support arm, thereby allowing for corner mounting of the adjustable foot rest; and a foot supporting and resting member connected to the other of said ends on said outer portions of said first and second support arms.

4. An adjustable foot rest for use in an environment having substantially vertical, bracket mounting channels, the adjustable foot rest comprising:

a pair of support arms, each of said support arms comprising:

(1) an inner portion including a sleeve and a telescoping member, said sleeve having opposed ends with a first toothed member on one end thereof and the other end thereof being open to receive said telescoping member, said telescoping member being slidable within said sleeve and having mounting means thereon for mounting of said arm to a bracket mounting channel; and (2) an outer portion having opposed ends, one of said ends having a second toothed member articulately connected to said first toothed member, there further being a threaded pin connecting said first and second toothed members, said outer portion being axially rotatable about said threaded pin;

a resting member having a first end pivotally connected to the other end of said outer portion of one support arm, and a second end pivotally connected to the other end of said outer portion of the other support arm; and said outer portion of each said support arm having a hinge with a vertically oriented pivot axis relative to each of said support arms.

* * * * *